US010370619B2

(12) United States Patent
Gaudreault

(10) Patent No.: US 10,370,619 B2
(45) **Date of Patent: *Aug. 6, 2019**

(54) STAIN REMOVING SOLUTION

(71) Applicant: Jelmar, LLC, Skokie, IL (US)

(72) Inventor: Rosemary Gaudreault, Park Ridge, IL (US)

(73) Assignee: Jelmar, LLC, Skokie, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/837,627

(22) Filed: Dec. 11, 2017

(65) Prior Publication Data

US 2018/0100122 A1 Apr. 12, 2018

Related U.S. Application Data

(62) Division of application No. 13/694,897, filed on Jan. 16, 2013, now Pat. No. 9,873,854.

(51) Int. Cl.

| | |
|---|---|
| ***C11D 3/43*** | (2006.01) |
| ***C11D 1/14*** | (2006.01) |
| ***C11D 1/12*** | (2006.01) |
| ***C11D 1/34*** | (2006.01) |
| ***C11D 1/72*** | (2006.01) |
| ***C11D 1/75*** | (2006.01) |
| ***C11D 1/78*** | (2006.01) |
| ***C11D 1/90*** | (2006.01) |
| ***C11D 1/92*** | (2006.01) |

(52) U.S. Cl.

CPC ..... *C11D 1/123* (2013.01); *C11D 1/14* (2013.01); *C11D 1/345* (2013.01); *C11D 1/72* (2013.01); *C11D 1/75* (2013.01); *C11D 1/78* (2013.01); *C11D 1/90* (2013.01); *C11D 1/92* (2013.01); *C11D 3/43* (2013.01)

(58) Field of Classification Search

CPC .. C11D 1/123; C11D 1/14; C11D 1/17; C11D 1/345

See application file for complete search history.

(56) References Cited

U.S. PATENT DOCUMENTS

| | | | | |
|---|---|---|---|---|
| 6,204,237 | B1 * | 3/2001 | Suzuki | C11D 7/5018 510/170 |
| 7,597,766 | B2 | 10/2009 | McRae et al. | |
| 7,893,014 | B2 * | 2/2011 | van Buskirk | C11D 3/0015 510/327 |
| 7,951,766 | B1 | 5/2011 | Frenkel et al. | |
| 2002/0168422 | A1 * | 11/2002 | Hei | A01N 25/02 424/661 |
| 2003/0073602 | A1 * | 4/2003 | Ramirez, Jr. | C11D 3/0026 510/421 |
| 2009/0281012 | A1 * | 11/2009 | Trivedi | C08G 65/3314 510/138 |
| 2012/0225943 | A1 | 9/2012 | Gohl et al. | |

FOREIGN PATENT DOCUMENTS

| | | | | |
|---|---|---|---|---|
| CA | 2276165 | | 12/1999 | |
| WO | WO 0023647 | A1 * | 4/2000 | C11D 17/047 |
| WO | 2008/042840 | | 4/2008 | |
| WO | 2009/060171 | A1 | 5/2009 | |
| WO | 2009/137096 | A1 | 11/2009 | |
| WO | 2011/049614 | A2 | 4/2011 | |
| WO | 2012/038755 | | 3/2012 | |
| WO | 2012/071059 | A2 | 5/2012 | |

OTHER PUBLICATIONS

International Search Report and Written Opinion of PCT Application No. US2013/41160, dated Oct. 1, 2013, 9 pages.

Canadian Intellectual Property Office, Office Action issued on Canadian patent application No. 2,816,064, dated Dec. 30, 2013, 6 pages.

Canadian Intellectual Property Office, Office Action issued on Canadian patent application No. 2,816,066, dated Dec. 30, 2013, 7 pages.

* cited by examiner

*Primary Examiner* — Nicole M. Buie-Hatcher
*Assistant Examiner* — M. Reza Asdjodi
(74) *Attorney, Agent, or Firm* — Richard D. Harris; Greenberg Traurig, LLP

(57) ABSTRACT

A solution having improved stain removing properties on hard surfaces, carpets and fabrics, that is easier to handle (stored or transported at lower temperatures and less corrosive) and that is environmentally friendly. The stain removing solution includes the following components: a surfactant selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolamides, sulfosuccinates, and sultaines, a hydrotrope, and a solvent. The surfactant is preferably an alcohol ethoxylate. The hydrotrope is preferably lauramine oxide. The solvent is preferably a dibasic ester or a glycol ether. The solution may further comprise a diluent, a mild acid, and/or a preservative. A mild acid can be added to lower the pH of the solution.

10 Claims, No Drawings

STAIN REMOVING SOLUTION

RELATED APPLICATION

This is a divisional application of U.S. patent application Ser. No. 13/694,897, filed on Jan. 16, 2013.

BACKGROUND OF THE INVENTION

1. Field of the Invention

The present invention relates in general to an improved solution for removing stains from hard surfaces, carpets and fabrics, that is easier to handle and store, and is also environmentally friendly.

2. Background Art

Stain removing solutions have been known and used in a variety of applications, including removing stains from hard surfaces, such as wooden and concrete floors, painted walls, stone countertops, floor and bath tiles, as well as composite or laminated materials that are on various household and office surfaces. Stain removing solutions are also called spot removers when being used to remove stains from carpets, rugs, and other fabrics, such as clothing, furniture, upholstery, and drapery. As part of daily household life, unwanted stains appear on such surfaces and materials, through food and drink spills, tracking of outdoor contaminants by dirty shoes and animals, bleed-through or over-writing from pens, markers or crayons, accidents resulting in the spill of human or animal blood or bodily waste, or spills of paint or nail polish, whose coloring went beyond its intended use and resulted in a stained or soiled hard surface, carpet or fabric. Typically, a small amount of a stain removing solution sprayed onto the surface may remove the stain, which is then wiped away using a cloth or paper towel.

Stain removing solutions have traditionally contained a higher pH level, such as 9.0 and higher. While higher pH solutions have been effective at removing stains, their high pH levels pose problems for the cleaner, as well as for the surface that is being cleaned. First of all, direct contact with a high pH solution can dry out or even burn the skin; protective gloves must be worn by the user. Furthermore, high pH solutions can also corrode hard surfaces and fabric while removing the stain. Depending on the severity of the stain and the type of surface or material being treated, a high amount of solution may be necessary to remove the stain. Prolonged exposure to a high pH cleaning solution can often result in corrosion, discoloration, or otherwise damage to more delicate surfaces, and for these reasons, is not recommended for use at all on delicate fabrics such as silks. For such applications, spot removing solutions are used. However, such solutions are not as effective at removing stains, and are often inconvenient for the user, who must purchase an additional stain removing solution for this purpose.

Stain removing solutions also are known to contain surfactants. However, many surfactants that are currently used in stain removing solutions solidify, or gel, at colder temperatures, causing the solution to separate, and the surfactant to fall to the bottom of the solution. If this should happen, such as during transport or storage of the solution during winter months, the solution may no longer be effective as a stain remover. Even if the temperature later rises, the surfactant is unlikely to thoroughly mix inside the container, such that when the solution is dispensed, it may or may not contain an effective amount of the surfactant to remove the stain.

Stain removing solutions are also known to contain solvents to dislodge the stain from the surface or fabric. Many solvents that are currently used in stain removing solutions have a high vapor pressure. Solvents having a high vapor pressure are known to be effective at dislodging a stain, especially at high pH levels, but not without considerable drawbacks. First, such solvents quickly flash off from the solution after they are applied, leaving the solution unable to penetrate a deep stain. Second, these solvents often smear or "ring" part of the stain onto another portion of the surface or fabric, rather than remove it from the surface or fabric completely. Third, solvents with a high vapor pressure often emit an odor that is unpleasant for the user. Finally, such solvents often emit high amounts of volatile organic compounds (VOCs) that are the subject of increasing regulation and public concern, which limit their use in household products.

It has also become important for stain removing solutions to be formulated in such a way as to have less impact on the environment. One way in which this is encouraged is through a program of the United States Environmental Protection Agency, known as the Design for the Environment Program ("DfE"). DfE certifies "green" cleaning products through the Safer Product Labeling Program. Another is through state regulatory bodies, such as the California Air Resources Board ("CARB"). Either through regulation, or through certification, these bodies set out standards for achieving environmentally friendly cleaning products. Among the standards, are the desire for a solution that is not as corrosive as prior art solutions, one having a more neutral pH level. Further, the solution must minimize the emissions of VOCs, as well as the percentage of solvent that it may contain.

Accordingly, it is desirable to provide an effective stain removing solution which is less corrosive than existing solutions for safer handling by the user, and to reduce the corrosive effects on the applied surfaces and fabrics.

It is further desirable to provide an effective stain removing solution, that may be transported and stored at cold temperatures, without concern of a key ingredient separating from the solution.

It is yet further desirable to find a single stain removing solution which may be applied to hard surfaces and delicate fabrics alike, and which meets any and all applicable environmental standards and regulations, with a specific combination of surfactants, solvents and hydrotropes—all of which act in a synergistic manner to improve their effectiveness in removing stains.

SUMMARY OF THE INVENTION

The present invention is directed to a stain removing solution. In one preferred embodiment, the solution comprises a surfactant selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolam ides, sulfosuccinates, and sultaines and a solvent selected from the group consisting of dibasic esters, towards effectively removing stains from hard surfaces, carpets and fabrics. In another preferred embodiment of the invention, the stain removing solution comprises a surfactant again selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolamides, sulfosuccinates, and sultaines, and a solvent selected from the group consisting of glycol ethers. In a preferred embodiment of the invention, the surfactant is selected from the group consisting of alcohol ethoxylates. The surfactant may comprise about 3% to about 8% of the stain removing solution. In one preferred embodiment of the invention, the surfactant is a hydrotrope.

In another preferred embodiment of the invention, the solution further comprises a hydrotrope. The hydrotrope may comprise about 1.5% to about 5% of the stain removing solution. The hydrotrope may be selected from the group consisting of amine oxides. In a preferred embodiment of the invention, the hydrotrope is lauramine oxide.

In another preferred embodiment of the invention, the solvent is dimethyl-2-methyl glutarate. In another preferred embodiment of the invention, the solvent is dipropylene glycol n-butyl ether. The solvent may comprise about 1.5% to about 6.5% of the stain removing solution.

In yet another preferred embodiment of the invention, the stain removing solution further comprises a diluent, in about 79% to about 94% of the solution.

In another preferred embodiment of the invention, the stain removing solution further comprises a mild acid, added in a sufficient amount to lower the pH of the solution to about 5.8 to about 7.5, preferably to about 6.3 to about 6.9. The mild acid is preferably selected from the group consisting of gluconic acid and lactic acid. The mild acid preferably comprises about 0.01% to about 1% of the stain removing solution.

In a further preferred embodiment of the invention, the stain removing solution further comprises at least one preservative. The preservative may be in about 0.001% to about 0.021% of the stain removing solution.

DETAILED DESCRIPTION OF THE INVENTION

While this invention is susceptible of embodiment in many different forms, there are described herewithin several specific embodiments, with the understanding that the present disclosure is to be considered as an exemplification of the principals of the invention and is not intended to limit the invention to the embodiments so described.

The present invention is directed to a stain removing solution which is particularly suited for removing food, ink, and paint stains from various hard surfaces found in homes, including wood floors, concrete, painted walls, tiles, and composite materials such as those used in kitchen or bathroom counters. The stain removing solution described herein is also intended to remove these, and other stains from more delicate surfaces and materials, including carpeting, furniture, clothing, drapery, and other fabrics. The present invention includes a stain removing solution that is effective at removing stains, while protecting the surface or material from the deleterious effects of corrosion, discoloration and other damage, while safeguarding the environment.

The stain removing solution of the present invention comprises at least a surfactant selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolamides, sulfosuccinates, and sultaines, and a solvent in the form of a dibasic ester or a glycol ether. In a preferred embodiment of the invention, the stain removing solution also includes a hydrotrope compound. The solution may further comprise a diluent, a mild acid, and/or a preservative.

The surfactant in the present stain removing solution performs the very important function of acting to physically separate a contaminating substance, from the surface or material to which the contaminating substance is adhered. The hydrotrope aides in the solubility of the surfactant, such that a higher amount of surfactant may be placed in solution to improve the performance of the stain removing solution. After the stain is separated by the surfactant, the solvent functions to dislodge the stain from the surface or material matrix, such that the stain may then adhere to a paper towel or cloth. The solvents can also dissolve those portions of the stain that act to adhere the stain to the material, such as oils and greases.

In a preferred embodiment of the invention, the stain removing solution includes a surfactant, a hydrotrope, a solvent, a diluent, a mild acid and a preservative.

Surfactant

As stated above, preferably the surfactant is selected from selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolam ides, sulfosuccinates, and sultaines. The surfactant is preferably an alcohol ethoxylate. Alcohol Ethoxylates ("AEs") have the advantage that they are not affected by water hardness or pH changes, and in many cases it is an advantage that they are considered medium to low foaming agents. AEs are prepared commercially by the reaction of an alcohol and ethylene oxide. An example of the chemical structure of an alcohol ethoxylate is shown below:

$$CH_3(CH2)_{x-y}O(CH2CH2O)_nH$$

x-y is the range of carbon units n is the average number of ethylene oxide units Structurally, AEs can be abbreviated as $C_{x-y}AE_n$ where the subscript following the 'C' indicates the range of carbon chain units. AEs with a carbon unit range between C3 to C16, are most commonly used in household detergent products. Further AEs contain an ethylene oxide (E) chain attached to the alcohol. The degree of ethylene oxide polymerization is indicated by the subscript 'n' which indicates the average number of ethylene oxide units. In household products, the ethylene oxide commonly ranges between 3 and 20 units, where units are ethylene oxide chains within the alcohol ethoxylate molecule. The fact that each product contains a mixture of molecules that covers a range of chain lengths (both in the alcohol and in the ethoxylate chain) has importance to the health and safety evaluation of AEs. The functional characteristics of two related products may be different, but their biological effects should be comparable.

The preferred AE surfactant of the present invention is Tomadol 900, comprising from about 3% to about 8% of the stain removing solution, most preferably in a 6.18% concentration in the formulation. Tomadol is a trademark owned by Tomah Products, Inc., Milton, Wis. Tomadol 900 is commercially available from Air Products & Chemicals, Inc., of Allentown, Pa. Tomadol 900, CAS No. 68439-46-3, comprises 60-100% C9-11 AEs, including C9-11AE4, C9-11AE6, and C9-11AE8. Other surfactant chemical groups that may be used in the present invention include: alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolam ides, sulfosuccinates, and sultaines.

Hydrotrope

A hydrotrope acts to improve the solubility of surfactants in aqueous solutions. Couplers, like solvents and more-soluble surfactant classes, can also be used to increase solubility. Hydrotropes are a special class of couplers requiring relatively low levels for solubilization of surfactants. A higher concentration of hydrotrope generally leads to higher cloud points, the point at which the surfactant concentration is large enough such that some of the surfactant will solidify, and thus fall out of solution. Hydrotropes are known to be useful in formulations containing a surfactant.

A wide range of molecular structures can lead to hydrotropic behavior. Usual hydrotropes present a weak amphiphilic character, with small hydrophilic and hydrophobic moieties. They can be, among others, aromatic salts (sodium xylene sulfonate SXS), aromatic alcohols (pyrogallol) or short-chain soaps (sodium n-pentanoate). Medium and short-chain alkylpolyglucosides (APG) have also been regarded as hydrotropes, as have been more unusual compounds such as long chain dicarboxylic acids. Short-chain amphiphiles derived from ethylene glycol (CiEj), propylene glycol (CiPj) or glycerol (CiGly1) also present hydrotropic properties. These compounds are sometimes called "solvo-surfactants" because they combine properties of surfactants (molecular structure surface-active properties) and of solvents (volatility, dissolving power).

Commercially available hydrotropes that may be used in association with the present invention include: b-alanine, n-(2-carboxyethyl)- and n-[3-(C12-15-alkyloxy) propyl] derivatives, alkenyl dicarboxcylic acid anhydride, alkyl polysaccharide, alkyl glucosides, alkyl polyglycol ether ammonium methyl chloride, amine oxides (including cocamidopropylamine oxide, lauramine oxide, myristamine oxide, and soyamidopropylamine oxide), benzyl alcohol ethylate, d-glucopyranose alkyl glycosides, disodium coco-amphodipropionate, sulfonic acid based hydrotropes (including sodium cumenesulfonic acid, xylenesulfonic acid, and toluenesulfonic acid), methyl-oxirane polymer, modified carboxcylic acid, modified carboxylate, organo phosphate amphoteric, modified phosphate ester, aromatic phosphate ester, natural fatty alcohol alkyl polyglucosides, potassium cocoate, sodium-n-lauryl-β-iminodipropionate, sodium octane sulfonate, and salts thereof.

There are several factors that must be considered in arriving at an appropriate hydrotrope. The hydrotrope must be compatible with the solvent, to ensure that the compounds are mutually soluble, and their surface tension must be low to allow the surfactant to penetrate the stain. Other considerations include cost, and synergistic effects when used in combination with a particular surfactant. It should be noted that there are some surfactants that also have the properties of a hydrotrope, and many of the hydrotropes listed above are also surfactants. Thus, a single chemical can be used as both the surfactant and the hydrotrope of the present invention. Such an arrangement often raises significant cost considerations.

The preferred hydrotrope to be used in the current invention is an amine oxide; more preferably, lauramine oxide ("LO"), which is also known as lauryldimethylamine oxide, dodecyldimethylamine oxide, or dimethyldodecylamine-N-oxide, comprising from about 1.5% to about 5% of the stain removing solution, most preferably 2.025% active in the formula. Lauramine oxide can be purchased under the trade name Mackamine LO from Rhodia Inc., located in Cranbury, N.J. Mackamine is a trademark owned by the McIntyre Group, Ltd., of University Park, Ill. Other alternative sources of lauramine oxide are Macat AO-12 (from Mason Chemicals) and Ammonyx LO (from Stepan Chemical). The addition of lauramine oxide as the hydrotrope has been found to increase the solubility of the surfactant, as intended, and also to increase the stability of the solution at higher temperatures. The solution described herein, with Tomadol as the surfactant and lauramine oxide as the hydrotrope, was found to be stable at temperatures as high as 50° C. for three months.

In addition to its properties as a hydrotrope, and as an example of the present invention, lauramine oxide has been found to generate an unexpected synergistic effect—when used in combination with Tomadol and the other ingredients of the stain removing solution described herein, particularly the solvent. The addition of lauramine oxide as a hydrotrope was found to increase the stain removing performance to levels that were only known to be possible with more corrosive solutions that have a higher pH level.

Solvent

Suitable solvents that may be used with the present invention include dibasic esters and glycol ethers. Of those solvents, the ones preferred for use in association with the present invention are low vapor pressure ("LVP") solvents, which also have a high flash point. LVP solvents are desirable for their solvent properties, while limiting VOC emissions in the resulting stain removing solutions. While high vapor pressure solvents may be desirable because of their performance, their use in a stain removing solution may create a higher than desirable level of VOC emissions. A high flash point refers to the temperature at which the solvent may ignite. Highly flammable solvents, such as acetone, ignite at lower temperatures, and therefore have a low flash point. Products that have a low flash point are not desirable for use or storage in the home. Other criteria that should be evaluated in choosing an appropriate solvent include solubility, stability in product, surface tension and cleaning ability.

One preferred solvent of the present invention is Rhodiasolv IRIS, a dibasic ester having the chemical name dimethyl-2-methyl glutarate, comprising from about 1.5% to about 6.5% of the stain removing solution, most preferably 4.75% active in the formula. Rhodiasolv is a trademark owned by Rhodia Corporation, of Courbevoie, France. Rhodiasolv products are commercially available in the United States from Rhodia Inc., of Cranbury, N.J. It is believed that Rhodiasolv IRIS further acts in an unexpected, synergistic manner in combination with the Tomadol surfactant and lauramine oxide hydrotrope, to quickly penetrate and remove stains. Through trial and error, it was discovered that the use of a dibasic ester solvent generated a more effective stain removing solution than traditional solvents. It is believed that the dibasic ester solvent is more effective at opening up the stain matrix, thus enabling the higher amount of surfactant present in the solution (because of the hydrotrope) to dislodge the stain from the surface. Other dibasic esters that may be used in the present invention include Rhodiasolv RPDE, Rhodiasolv STRIP, and FlexiSolv DBE Esters. Flexisolv is a trademark of Invista Specialty Materials, of Wilmington, Del.

Alternatively, a glycol ether may be used as the solvent. The preferred glycol ether that may be used as the solvent is dipropylene glycol n-butyl ether, sold under the trade name Dowanol DPnB. Other Dowanol low vapor pressure solvents that may be used with the present invention include Dowanol TMP, Dowanol DPnP, Dowanol TPnB, Dowanol PPh, Dowanol EPh, and Dowanol DPMA. Other low vapor pressure glycol ethers that may be used include Carbitol, butyl Carbitol, Hexyl Carbitol, and butyl Carbitol acetate. Both Dowanol and Carbitol are trademarks of The Dow Chemical Company, of Midland, Mich.

Remaining Ingredients

Other components that may be added to the stain removing solution, include a diluent, a mild acid, and a preservative.

The diluent is preferably deionized water, added to achieve the desired concentrations of the active ingredients in the solution, as well as to reduce the vapor pressure. The diluent of the present invention comprises about 79% to about 94% of the stain removing solution, most preferably 87%. While the diluent is not an active component in removing stains, its addition to the stain removing solution is highly desirable, because the active ingredients are typically available in a highly concentrated form. Therefore, a diluent can reduce the concentrations of the active constituents to their desired amounts.

The mild acid may be needed to adjust the pH, depending on the choice of solvent, and the desired stability properties of the invention. In the case of a dibasic ester solvent, the pH should be adjusted to the desired level of about 5.8 to about 7.5, preferably about 6.3 to about 6.9, most preferably 6.6. A stain removing solution that contains only a surfactant selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphoproprionates, amphosulfonates, amine oxides, alkanolamides, sulfosuccinates, and sultaines, a hydrotrope, a solvent, a diluent, and a preservative has been found to have a pH of about 7.5 to about 11, though the level has been found to vary depending on the choice of surfactant. Such a high pH level has been found to be incompatible with the preferred dibasic ester solvent, whose preferred operating pH range is 4.5 to 7.5. In the case of a glycol ether solvent, the pH does not need to be adjusted for the solvent to be effective in the stain removing solution. At pH levels below 5.8, it was found that the stain removing solution was too acidic, and unfavorably reacted with certain hard surfaces that are found in the home. At pH levels above 9.5, it was found that the stain removing solution was too corrosive on certain hard surfaces and fabrics, and was difficult to handle. Accordingly, a mild acid may be added to the stain removing solution, in amounts necessary to reduce the pH to levels that are compatible with the other active ingredients, or to make the solution less corrosive and easier to handle, but not in amounts that would make the solution reactive with surfaces found in the home.

An additional benefit of adding an acid, is an increased stability of the stain removing solution. Adding acid has been found to stabilize the pH level of the solution, and to prevent the components of the solution from separating, or stratifying. Furthermore, adding acid has also been found to make the solution more stable over a wider range of temperatures. Therefore, even if the solution is at the desired pH level, the addition of an acid may nonetheless achieve these other benefits.

The preferred mild acid is gluconic acid, present in an amount of approximately 0.01% to about 1.0% active in the formula, most preferably about 0.07%. Another suitable mild acid is lactic acid. While stronger, inorganic acids may also be used with the present invention, there is a risk of making the stain removing solution too acidic when adding strong acids. Furthermore, any alternative acid should preferably impart the same benefits of increased stability to the stain removing solution, as gluconic and lactic acid. Gluconic acid is available from PMP Fermentation, of Peoria, Ill.

Finally, a preservative may also be added, depending on the final pH of the product. A preservative works to prevent the growth of bacteria or fungi in the stain removing solution, and is not believed to have any role in removing a stain. The preferred preservative is Kathon CG/ICP, which itself comprises two chemicals having the formulas 5-chloro-2-methyl-4-isothiazolin-3-one and 2-methyl-4-isothiazolin-3-one. Kathon is a trademark of The Dow Chemical Company, of Midland, Mich. The preservative is present in an amount of approximately 0.001% to about 0.021%, most preferably about 0.015%.

The following example is given to illustrate the stain removing solution of the present invention, but is not intended to limit the invention to the example included herewith. The following example specifically illustrates an exemplary and preferred formulation of the stain removing solution according to the present invention. It is to be understood that the examples are presented by means of illustration only and that further use of formulations that fall within the scope of the present invention and the claims herewith may be readily produced by one skilled in the art with the present disclosure before them.

Preparation of the Cleaning Solution Formulation

An example formulation illustrating an embodiment of the inventive stain removing solution of the present invention is described in detail in Table I below and was formulated generally in accordance with the following protocol.

Example 1

Stain Removing Solution Formulation 1

A stain removing solution according to the first embodiment of the present invention was prepared, by introducing appropriate amounts of the indicated constituents, so as to attain the desired relative weight percentages indicated in Table 1 hereinafter, by first charging deionized water into a tank equipped with a mixer. Lauramine oxide, in the form of Mackamine LO, was then added to the tank from below the surface of the liquid in the tank to minimize foaming, and mixed about 30 minutes until the solution was homogenous and clear. Tomadol 900 was then added in the same manner, and mixed until the solution was clear. The solvent, Rhodiasolv IRIS, was added after the Mackamine LO and Tomadol 900, and then mixed until the solution was homogenous. The preservative was then added, and mixed in with the solution for fifteen minutes. Next, 50% of the expected amount of gluconic acid was added to the tank, and mixed for 30 minutes. The remaining gluconic acid was added in smaller amounts, and then mixed for 30 minutes, after checking the pH of the solution to make sure the desired pH level is reached. Additional deionized water may be added in place of gluconic acid if the desired pH level is achieved, to avoid the solution from becoming too acidic.

In as much as various ones of the raw material components of the stain removing solution are purchased in a form that is at least partially diluted with water, Table 1 provides the percentage of each component which is active in the raw material, the percentage of each particular component (active material and any water in the raw material solution) in the formula and the percentage of each component in the active portion of the formula.

TABLE 1

| Stain Removing Solution Formulation 1 | | | |
|---|---|---|---|
| Ingredient Name | % Active in Raw Material | % in Formula | % Active in Formula |
| Deionized Water | | 82.114 | N/A |
| Mackamine LO (Rhodia) | 30 | 6.750 | 2.025 |
| Tomadol 900 (Air Products) | 100 | 6.180 | 6.180 |
| Rhodiasolv IRIS (Rhodia) | 100 | 4.750 | 4.750 |
| Kathon CG/ICP (Dow) | 21 | 0.070 | 0.015 |
| Gluconic Acid (PMP Fermentation) | 50 | 0.136 | 0.068 |

Testing of Example Cleaning Solution Formulation

The stain removing solution of the present invention was evaluated for stain removing performance, in comparison to two commercially available reference solutions that are currently marketed as stain removers. Stain Removing Solution Formulation 1 (Solution Formulation 1) was subjected to testing by an independent laboratory to measure the formulation's ability to remove various stains, according to several standardized test methods, as detailed in Table 2.

TABLE 2

| Comparison Testing of Stain Removing Solution Formulation 1 | | | | |
|---|---|---|---|---|
| Stain | Method | Solution Formulation 1 | Reference Solution A | Reference Solution B |
| red nail enamel/ white oak with two coats of gloss | Mod. ASTM D4488-5 | 0.74% | 7.48% | 6.72% |
| black Bic ink/Latex painted Masonite wallboard | CSPA DCC-17 | 2.14% | 0.82% | 7.70% |
| dark blue crayon/ Latex painted Masonite wallboard | CSPA DCC-17 | 14.47% | 10.86% | 10.22% |
| black Sharpie (permanent marker)/ white matte Formica | Mod. ASTM D4488-5 | 24.78% | 94.88% | 99.84% |
| red nail enamel/ white matte Formica | CSPA DCC-17 | 48.40% | 33.09% | 77.13% |
| Valspar gloss black paint/concrete | CSPA DCC-17 | 95.66% | 85.03% | 94.49% |
| red Sharpie (permanent marker)/ white vinyl tile | CSPA DCC-17 | 97.38% | 76.38% | 97.72% |
| red wine/white wool carpet | CRI TM-110 carpet spot cleaning | 4.8/5.0 | 3.0/5.0 | 4.0/5.0 |
| red nail enamel/silk | CRI TM-110 carpet spot cleaning | 4.0/5.0 | 1.5/5.0 | 3.0/5.0 |

As shown above, the Stain Removing Solution Formulation 1 was effective in removing the stains, often at levels either equivalent to, or even far surpassing, the removals measured for the commercially available reference solutions. In particular, the stain removing solution unexpectedly proved to be much more effective in removing stains from fabrics, including carpet and silk, than the reference solutions. In addition, Stain Removing Solution Formulation 1 has significant other benefits over the reference solutions, in that it may be stored or transported at lower temperatures without one of the active ingredients separating from the other components. Furthermore, the reference solutions are not believed to meet all of the same environmental standards, and thus may not be available if consumers or regulatory bodies further limit such VOC-emitting products. Finally, the Stain Removing Solution Formulation 1 of the present invention was found to be more effective in removing deep stains, and did not smear or "ring" any of the stains.

While this invention is susceptible of embodiment in many different forms, there is shown in the drawings and will herein be described in detail, several preferred embodiments, with the understanding that the present disclosure should be considered as an exemplification of the principles of the invention and is not intended to limit the invention to the embodiment so illustrated.

The invention claimed is:

1. A stain removing solution comprising:

a surfactant selected from the group consisting of alcohol ethoxylates, alkyl sulfates, alkyl ether sulfates, alpha olefin sulfonates, alkyl phosphates, alkyl amidopropyl betaines, alkyl betaines, amphoacetates, amphopropionates, amphosulfonates, amine oxides, alkanolamides, sulfosuccinates, and sultaines, said surfactant comprising about 3 wt. % to about 8 wt. % of the stain removing solution;

a glycol ether solvent, in an amount of about 1.5 wt. % to about 6.5 of the stain removing solution;

a hydrotrope for extending the shelf life of the solution and for stabilizing the solution over a wide range of temperatures, said hydrotrope comprising lauramine oxide, in an amount of about 1.5 wt. % to about 5 wt. % of the stain removing solution; and a mild acid, in an amount sufficient to lower the pH of the stain removing solution to range from about 5.8 to about 7.

2. The stain removing solution of claim 1 wherein the surfactant is selected from the group consisting of alcohol ethoxylates.

3. The stain removing solution of claim 1 wherein the solvent is dipropylene glycol n-butyl ether.

4. The stain removing solution of claim 1 wherein the solution further comprises a diluent, in about 79 wt. % to about 94 wt. % the stain removing solution.

5. The stain removing solution of claim 1 wherein the mild acid is selected from the group consisting of gluconic acid and lactic acid.

6. The stain removing solution of claim 1 wherein the mild acid comprises about 0.01 wt. % to about 1 wt. % of the stain removing solution.

7. The stain removing solution of claim 1 wherein the solution further comprises a preservative.

8. The stain removing solution of claim 7 wherein the preservative comprises about 0.001 wt. % to about 0.021 wt. % of the stain removing solution.

9. A stain removing solution comprising:

a surfactant comprising an alcohol ethoxylate, in an amount of about 3 wt. % to about 8 wt. % of the stain removing solution;

a hydrotrope comprising an amine oxide, in an amount of about 1.5 wt. % to about 5 wt. % of the stain removing solution;

a solvent comprising a glycol ether, in an amount of about 1.5 wt. % to about 6.5 wt. % of the stain removing solution;

a diluent, in an amount of about 79 wt. % to about 94 wt. % of the stain removing solution; and a mild acid, in an amount sufficient to lower the pH of the stain removing solution to about 5.8 to about 7.

10. The stain removing solution of claim 9 wherein the mild acid comprises gluconic acid.

* * * * *